United States Patent [19]

Planck

[11] 4,031,567

[45] June 28, 1977

[54] HEADDRESS

[76] Inventor: Jane S. Planck, 939 26th St. NW., Washington, D.C. 20037

[22] Filed: Feb. 26, 1976

[21] Appl. No.: 661,680

[52] U.S. Cl. ..... 2/204; 2/174
[51] Int. Cl.[2] ..... A42B 1/04
[58] Field of Search ..... 2/204, 198, 207, 174, 2/202, DIG. 6, 171

[56] References Cited

UNITED STATES PATENTS

| | | | |
|---|---|---|---|
| 1,239,910 | 9/1917 | Harris | 2/174 |
| 1,600,530 | 9/1926 | Becker et al. | 2/174 UX |
| 2,162,608 | 6/1939 | Davis | 2/174 |
| 2,294,593 | 9/1942 | Bailey | 2/174 |
| 2,522,251 | 9/1950 | Beguhn | 2/174 |
| 3,392,737 | 7/1968 | Fefferman | 2/198 UX |
| 3,556,115 | 1/1971 | Benson | 2/174 X |

OTHER PUBLICATIONS

Gershman, "Self Adhering Nylon Tapes," 10–18–58, J.A.M.A. vol. 68, No. 7.

*Primary Examiner*—Werner H. Schroeder
*Assistant Examiner*—Peter Nerbun
*Attorney, Agent, or Firm*—David H. Semmes

[57] ABSTRACT

A headdress of the type adapted for both convenience and practical wear, including a head covering fabric, configured as a semi-circle with its leading edge diameter defined as a headband and having fastening members extending laterally on each side of the semi-circle and with its semi-circular trailing edge defining an arcuate body portion contiguous with the headband and adapted for covering the head and neck of the wearer. Complementary fastening means are secured to the fastening portions so as to secure said portions to each other at a point of overlap adjacent to the nape of the wearer's neck. Also, opposed frictional engagement pads may be fitted to the headband as an assistance in securely positioning the headband upon the wearer's head.

3 Claims, 12 Drawing Figures

FIG. 11
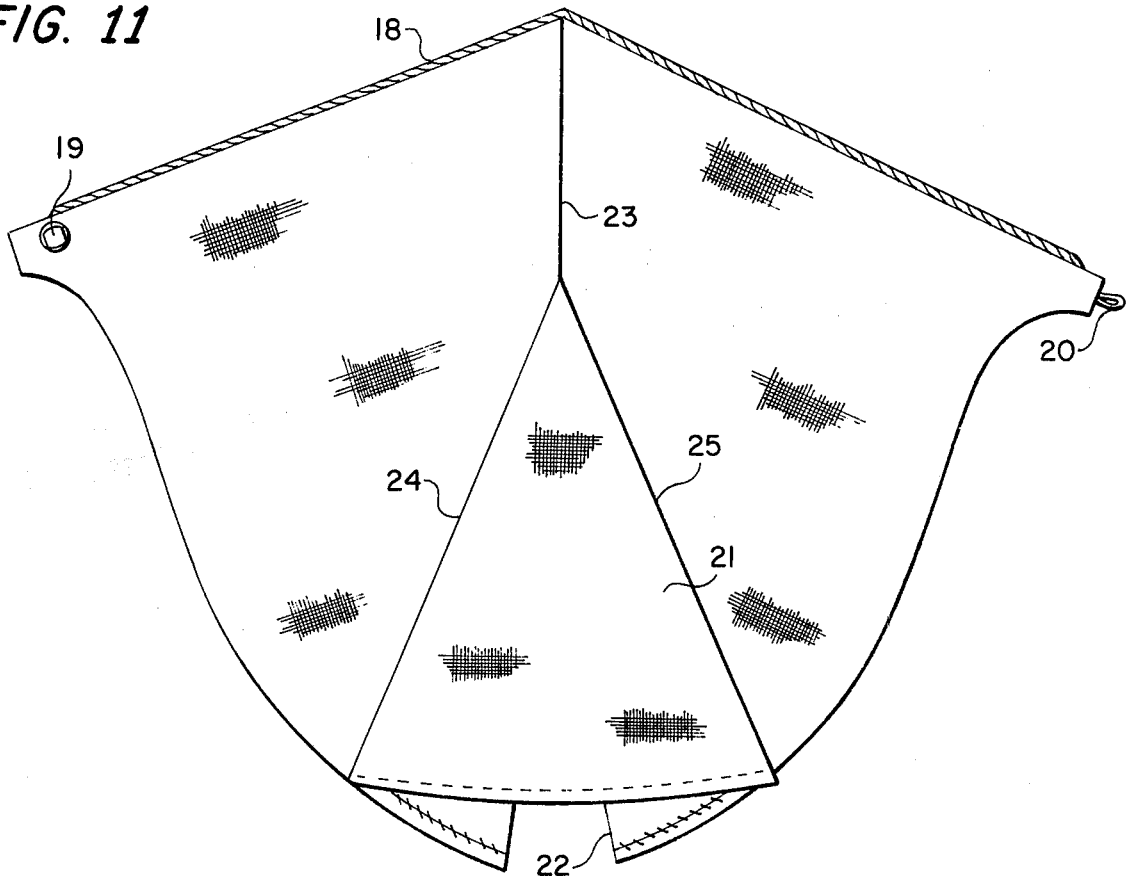
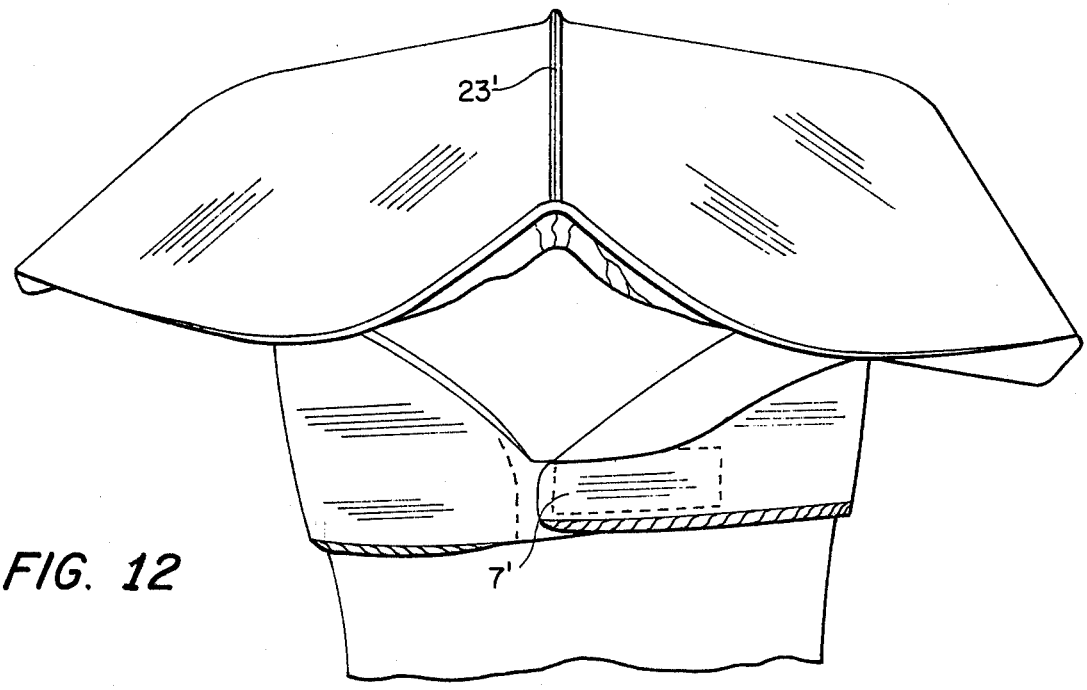
FIG. 12

HEADDRESS

BACKGROUND OF THE INVENTION

1. Field of the Invention

Head coverings, particularly those adapted for practical purposes of protecting the head from weather extremes and convenience purposes of beautifying the wearer.

2. Description of the Prior Art

WYNER U.S. Pat. No. Des. 110,162
DOBBS U.S. Pat. No. Des. 134,271
YOUNG U.S. Pat. No. Des. 179,831
SULLIVAN U.S. Pat. No. Des. 178,023
SMITH et al. U.S. Pat. No. Des. 142,915
Rains U.S. Pat. No. Des. 118,441
FUCHS U.S. Pat. No. Des. 138,306
ROSENSTEIN U.S. Pat. No. Des. 139,914
McCalls, May 5, 1954 "Hairdo Hats Available at Lord & Taylor, New York" (Classification XD2-239)
Woman's Day, July, 1952 Beach Bonnet
Vogue, February, 1966 (Classification XD2-239)

Xeroxes of the McCall's, Women's Day and Vogue citations are enclosed.

The field of search has included Class 2, subclasses 90, 150, 171, 174, X, 175, 192XR, 195–199, 201 202–205, 207, 90, 150 (3,222,683), 171, 174, X, 175, 192XR, 195–7–8–9, 201, 202, 3, 3, 5, 7, 209.1 (3,376,581/3,818,158) 209.3, 243, 4, 5, 7, 8, 9, 250, 1, 2, 98, 207, 209.3 Cited Most., 204.

The prior art teaches the employment of triangular or rectangular head coverings which have a leading edge headband engaging the forepart of the wearer's head and is secured at its end of the nape of the wearer's neck. However, the prior art does not suggest the employment of frictional engagement pads on the interior of the headband which assist in securely positioning the head piece upon the head. Also, the prior art does not show the combination of headband, frictional engaging pads and Velcro end fasteners together with styling of the garment by removal of wedge-shaped segments from the head covering portion and stitching of one or more styling darts.

Wyner is a typical triangular fabric head covering with a trailing edge securing lace. Dobbs shows a leading edge headband which is securable at the nape of the neck. However, there is no suggestion of employing frictional engaging pads on the inside of the headband nor of employing in the combination a special fastening means, such as Velcro or button and eye at the opposed ends of the headband. Also, Dobbs is devoid of suggestion of employment of styling darts in the head covering portion.

SUMMARY OF THE INVENTION

A multipurpose head covering for women that can, in appropriate materials, provide adequate protection from rain, sun, snow, and wind, or in other appropriate materials can provide an attractive heat covering for public appearance at a broad spectrum of occasions. It comprises a single, or double, layer of fabric of a generally half circle arcuate shape and is provided with a construction feature that holds it securely in place on the head. The head covering is capable of adjustment to fit a wide range of head sizes without requiring further mechanical changes. An additional convenience feature allows the head covering to be compacted to fit into a small carrying case and carried in a handbag or car drawer ready for immediate use.

The invention described herein is for an article of apparel, specifically a head covering for women; but equally adapted for use as a separate collar, or neck scarf, by itself, or in paired combination with the head covering, to enhance a basic dress or costume.

Traditionally, kerchief head scarves, or variations of them, from babushkas to out Western bandanas have continued in use down through the ages but have never achieved widespread popularity. Their use has normally derived from expediency rather than from any irresistible appeal. They have been, and are, worn because it is frequently necessary for women to cover their heads, either for warmth; to keep their hair from blowing in the wind; to keep the sun off; to hide a hair problem; or for numerous other reasons. Yet such kerchiefs seldom enhance a woman's appearance and never when tied under the chin.

However, because of their practicality, and for one or more of the aforementioned reasons women will continue to wear a form of head scarf right on through future centuries.

With the greatly increased activity of today's woman there is a real need for a versatile head covering capable of being both practical and attractive. Previous devices and designs have failed to meet this common need. For the most part they have been too complicated to manipulate easily, or too casual to be appropriate for all occasions, thus they have had a limited appeal and use. The present design meets both of these requirements besides having the additional advantage of employing a practical fastening method that permits instant adjustment to a variety of head sizes and/or hair styles.

In view of the preceding remarks it is:

1. The expressed object of this invention to provide a practical design for a head covering while at the same time enhancing the appearance of the wearer. This head covering is of a simple design that also premits its use as a collar or scarf; and the combination of a matched pair provides both a head covering and neck scarf or collar that converts any basic dress into an attractive ensemble, thus further extending its versatility.

2. Another objective of the invention is to provide a maximum simplicity of design that makes the headdress economical to manufacture, and that can be readily adapted to mass production.

3. A further object of this invention is to produce it in water repellant materials for its use as a rain bonnet, or a covering for wet hair, either at the beach or after shampoos. 4. Yet another object is to produce this head covering in a wide range of materials that will make it suitable for use in varying seasonal conditions.

5. Another object of this invention is to permit it to be compacted for carrying in a purse size case.

6. A further object of this invention is to produce it in a sufficient variety of fabrics in both solid colors and designs that can complement or match basic costumes, while at the same time providing pleasing variations and decoration of the basic design to make it desirable to a broad range of tastes.

7. Among other objects of this invention is to incorporate a unique feature in its design that enables the head covering to maintain an attractive position on the head both in normal wear and under strong wind conditions.

8. Still another object of this invention is to enable its position to be shifted immediately to fasten under the chin to provide ample protection to the head and contiguous areas in instances of sudden, gale force winds, heavy rain, or in a snow storm.

9. It is also the object of this invention to provide an attractive means for controlling long hair.

10. Another object of this invention is to provide a self-adhering closing of the headband that makes this head covering equally adaptable to a wide range of head sizes without requiring further mechanical alteration or adaptation of the closure in order to accommodate varying head sizes.

Other specific advantages will be indicated as the basic construction is set forth in the accompanying drawings:

FIG. 11 is a further modification employing the hook and eye fastener together with a pyramidal rear-view presentation formed by three darts and the removal of a wedge-like portion.

FIG. 12 is a side elevation of a configuration along the lines of FIG. 11, yet having Velcro fastening means.

DESCRIPTION OF THE INVENTION

Figure 1:
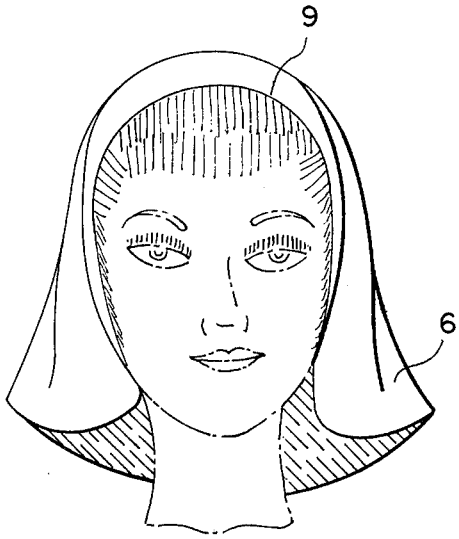
FIG. 1 is a front view of the head covering showing braid piping edging the head band.
Figure 2:
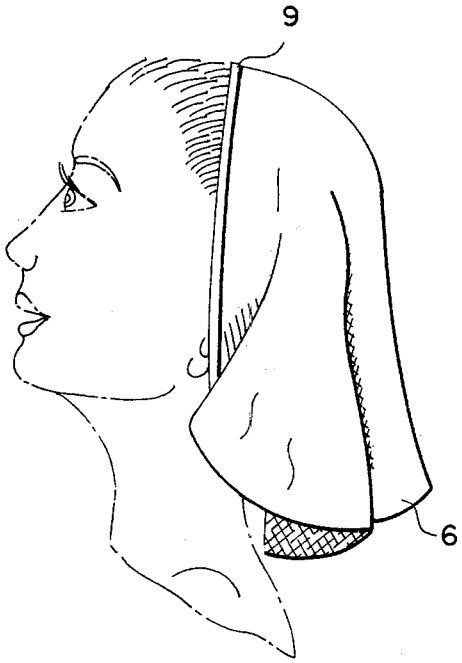
FIG. 2 is a profile view of the head covering.
Figure 3:
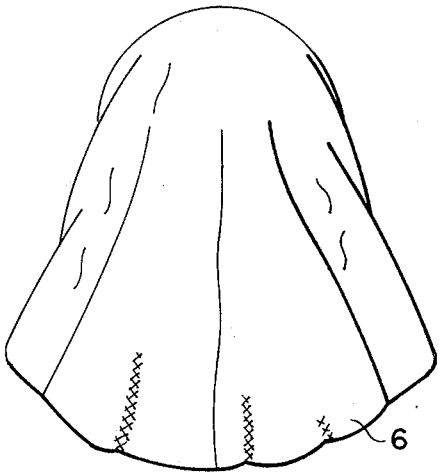
FIG. 3 is a back view of the head covering.
Figure 4:
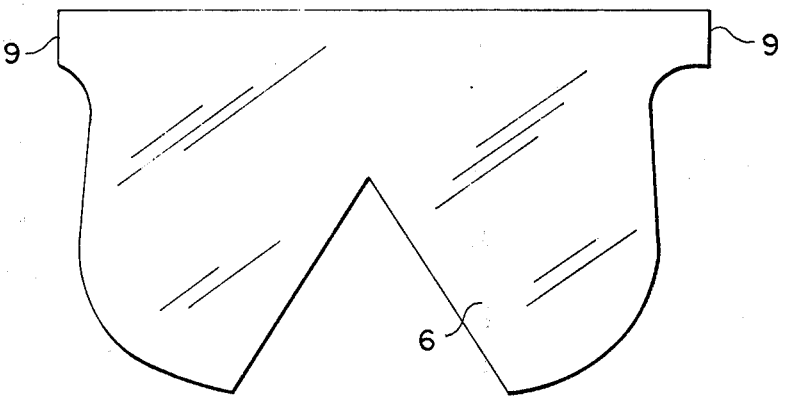
FIG. 4 is a flat plan view of the head covering pattern used for both top plie and lining. The dart is not made a part of the pattern when the fabric used is light weight enough to permit a graceful drape at the back of the head without it.
Figure 5:
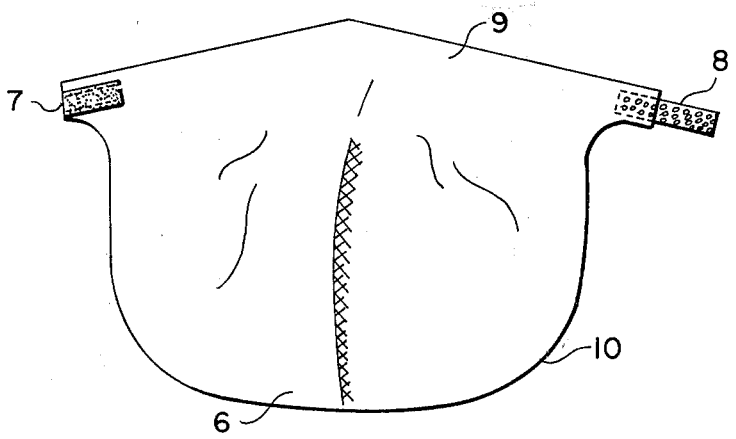
FIG. 5 is a plan view of the general shape of the finished head covering.
Figure 6:
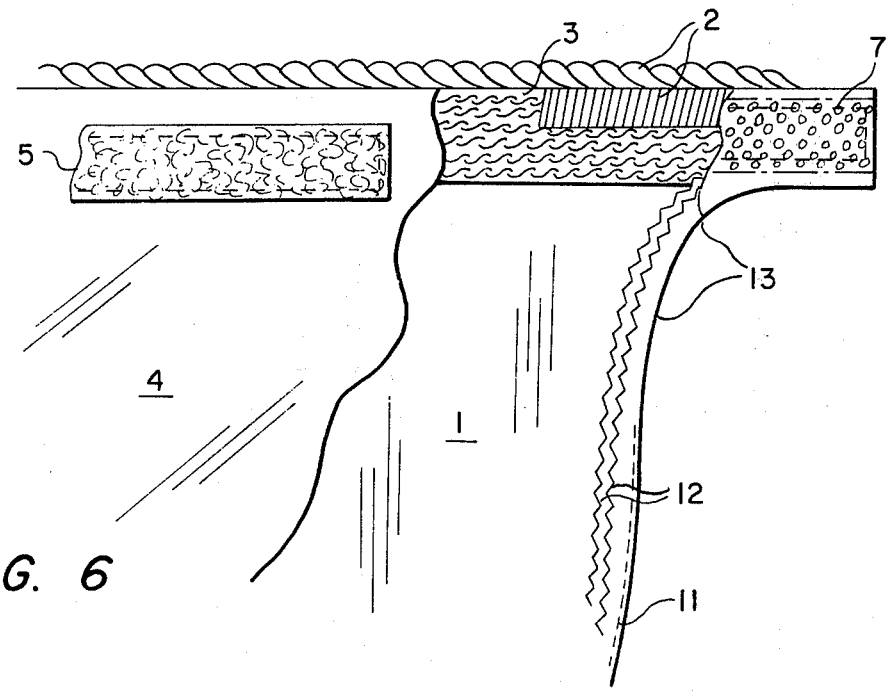
FIG. 6 is a fragmentary, partially sectional construction features of the head covering showing elements possible of use are incorporated in the finished product.
Figure 7:
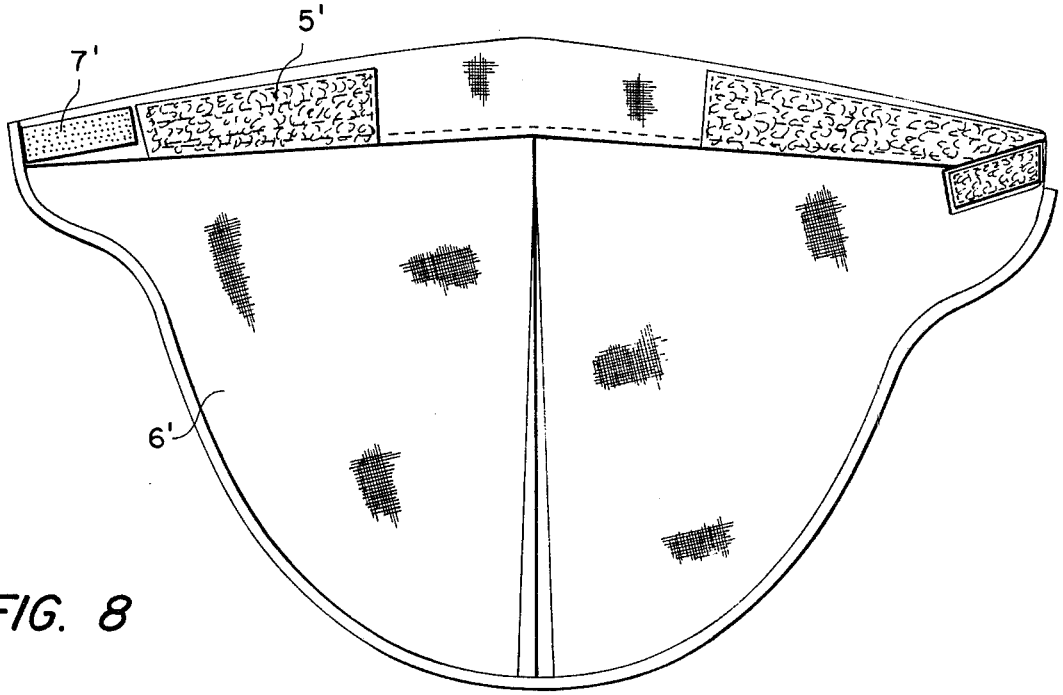
FIG. 7 is a bottom plan view of a form of the invention having opposed frictional engagement pads with a Velcro fastener affixed to opposed fastening portions.

Referring now particularly to the drawings, the head covering comprises two identical size arcuate shaped layers, or plies 1, 4 of fabric (FIG. 4), or other flexible material stitched or otherwise suitably joined together with various additional features 2, 3, 5 incorporated in the headband section 9 and in the body proper 1, 4, 6 for the express purpose of augmenting its utility and attractiveness as in the use of an interlining 3 for reinforcement and of a braid piping inset 2 for a decorative addition. In all instances of utilization of smooth finish materials, a suitable non-slip strip of material 5, is added to the lining 4 to hold the device firmly in place on the head. With proper materials the lining feature 4 is confined to the headband section 9. The head covering is secured at the nape of the neck by fasteners 7, 8 attached to each end of the headband section 9 that can be readily adjusted to make the device fit a wide variety of head sizes, and are of sufficient tension to hold the device firmly in place. The basic plan of the design is cut with the headband section 9 placed parallel to the width of the fabric and cut around the arcuate portion 10 to conform generally with the outline as shown in FIG. 4. The headband section 9 is placed around the head with each end meeting to fasten at the nape of the neck with the arcuate portion 10 covering the head and draping gracefully at the back of the neck. Generally, the design is cut with the straight of the material but the texture of some materials dictates the use of a bias cut. When this is necessary a narrow interlining strip 3 is incorporated in the headband section 9 to prevent undue stretching of the headband 9 while in use. The weight, design, and texture of materials used in the finished product is determined by the season and the degree of formality intended. They can comprise a wide variety of design, weave, and texture, including water repellant materials. When a particular material produces a better drape without a lining, the arcuate portion is finished with a turned hem and other decorative features can be added.

The headband section 9 is constructed generally of a top plie 1, a lining 4, and reinforced with a narrow strip of interlining 3 incorporated in the headband 9 when the texture of the material requires it. The dart 6 fabric is incorporated in the lining 4 before the head covering is assembled for stitching. It is positioned 2½ inches from the front of the headband section 9 and extended four to six inches each way from its beginning adjacent the headband section 9. When braid piping 2 is made a part of the headdress it is incorporated in the headband section 9 at the same time as the lining 4, interlining 3, fastener 7, and top plie 1. With right sides together a continuous ½ inch seam is stitched around the headdress, leaving one small section 13 open to allow the material to be turned to the right side. Before turning, all seams are pinked 12 in graduated layers. This permits a more relaxed and graceful draping of material at the back of the head. After turning the headdress to the right side and securing the section left open 13, the female fastening device 7 is stitched flat to the end of the headband section 9 opposite the male fastening device 8. The headdress is finished with pressing. When desired the head covering may be embellished with suitable decorations.

Figure 8:
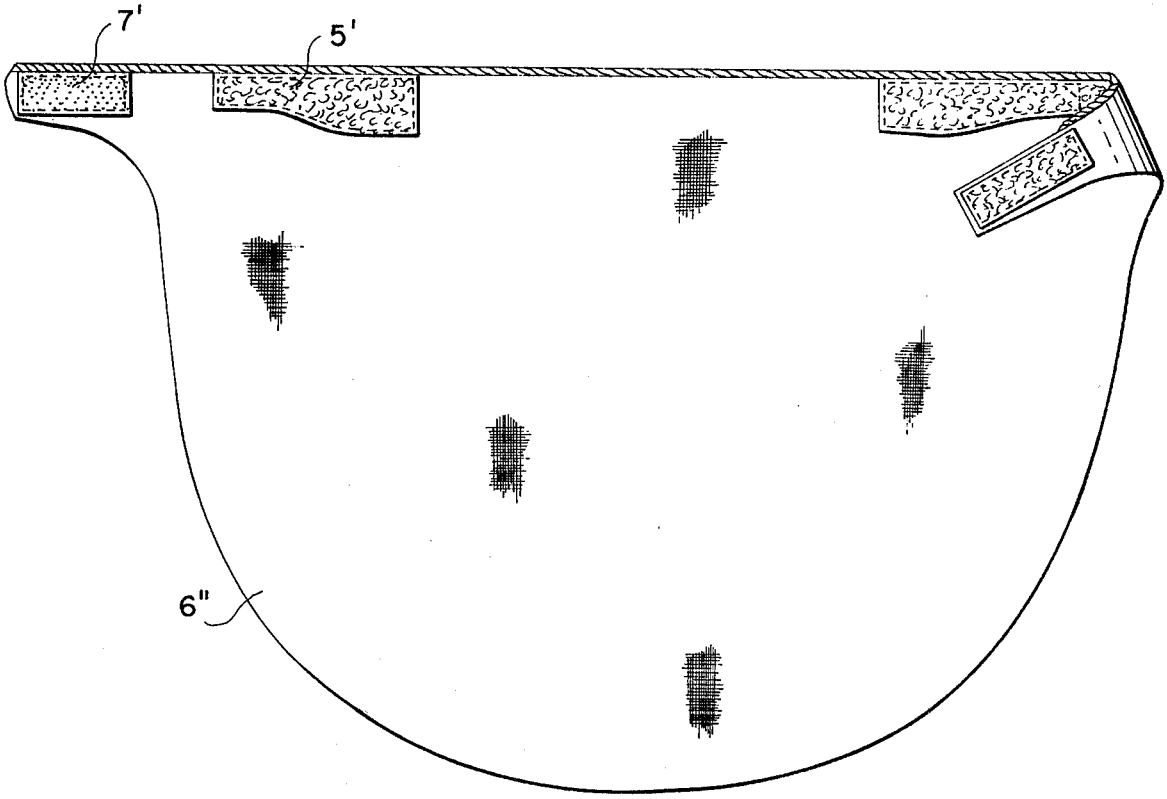
FIG. 8 is a further modification wherein the dart is omitted.

FIG. 8 shows a modified semi-circular head covering section having laterally extending elbows at each end and employing the suggested Velcro fastener 7′, as well as the frictional pads 5′.

In FIG. 8 the head covering portion 6″ is of a bell-shaped configuration.

Figure 9:
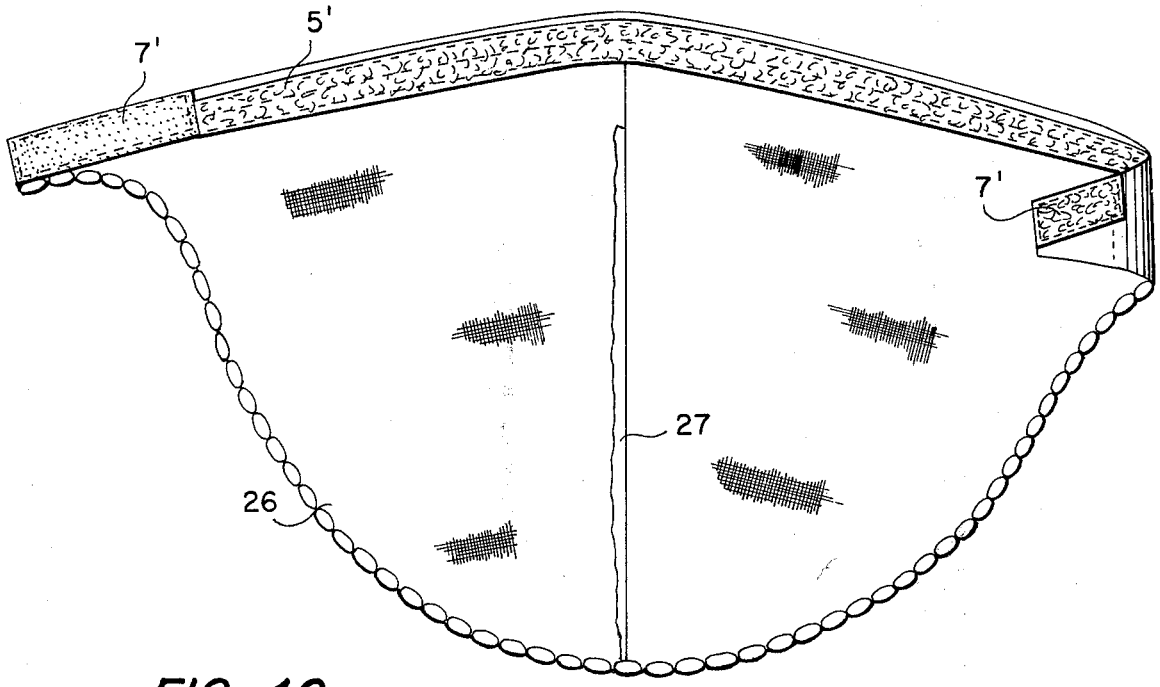
FIG. 9 is another modification wherein the frictional engaging pad extends the entire length of the headband intermediate the fastening portions.

In FIG. 9 the headband has a frictional engaging pad 5′ extending across its entire length to the opposed Velcro fasteners 7′ at each end. An optional braid 26 may be employed on the trailing edge of the head covering body portion and a stitched dart 27 may define the central axis of the head covering portion.

Figure 10:
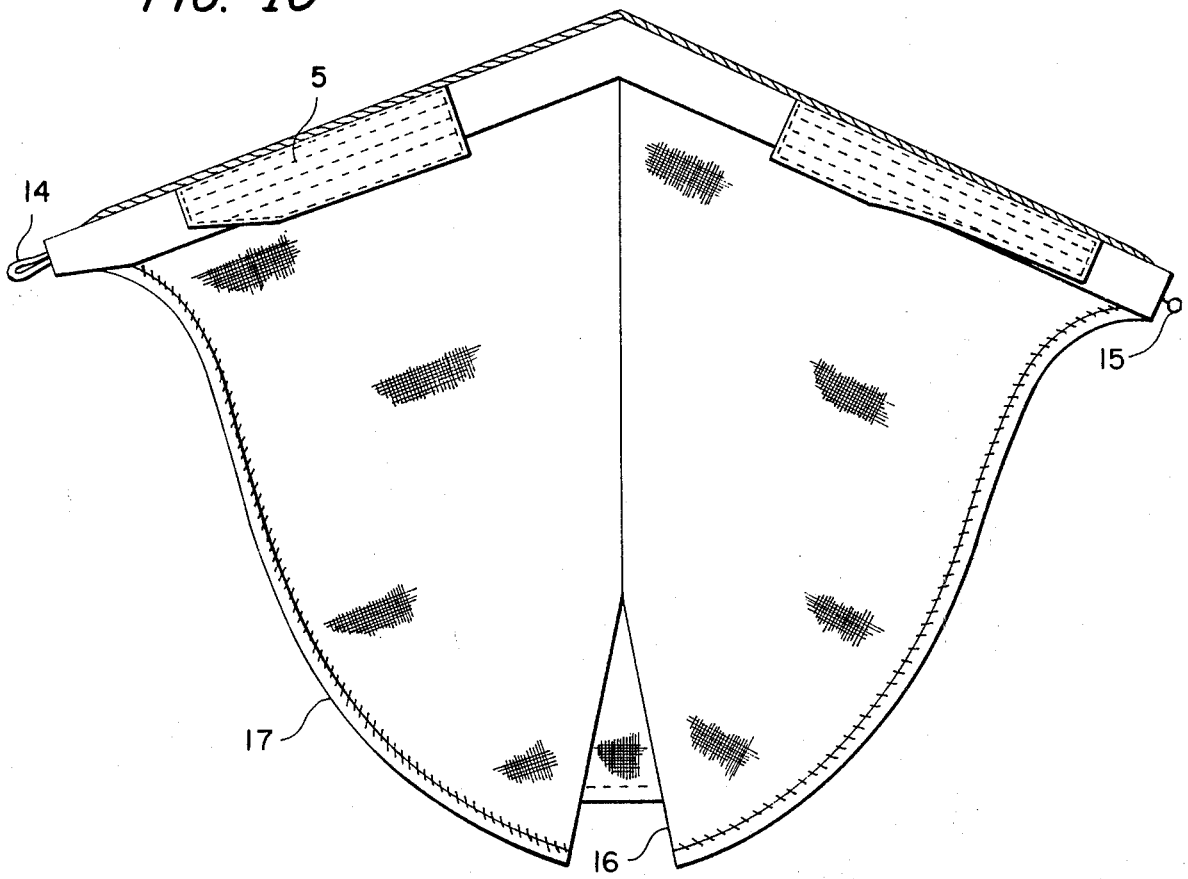
FIG. 10 is a further modification, embodying hook and eye fasteners, an escalloped trailing edge, and a wedge-like portion removed for styling by one middle dart and two side darts.

In FIG. 10, the headband may be cut on the diagonal having hook 15 and eye fastener 14 with a trailing edge braid 17 and a dart superposed with respect to a wedge-like segment 16 by the stitching of three radial darts.

In FIG. 11 the headband may be defined similarly such that the fastening members 19 and 20 are angularly disposed with respect to the head covering portion. A perimeter portion 21 is defined by separating a wedge-like segment 22 and the stitching of middle stitch 23 and adjacent radially extending stitchings 24 and 25.

This arrangement is presented in side elevation in FIG. 12 wherein the darts 23′ and 24 (illustrated in phantom) support the perimeter portion. A conventional Velcro fastener may be employed.

I claim:

1. A headdress comprising:

A. a head covering fabric, configured as a semi-circle and having:

i. a leading edge diameter as a headband with fastening portions extending laterally on each side of said semi-circle, said headband at its median portion being positioned over the forehead and adjacent the ears of the wearer with said fastening portions over lapping and being secured to each other behind the head at the nape of the neck; and ii. a semi-circular trailing edge defining an arcuate body portion contiguous with said headband and adapted for covering the head and neck of the wearer in which a wedge-like segment is removed from the center of said semi-circle from its trailing edge inwardly and the opposed sides exposed by said wedge are joined by stitching as a dart extending from the nape of the neck towards the dome of the wearer's head;

B. complementary fastening means secured to said fastening portions, so as to secure said portions to each other at a point of overlap adjacent the nape of the wearer's neck; and C. at least one frictional engagement pad supported on the underside of said headband, so as to engage a side of the wearer's head.

2. A headdress comprising:

A. a head covering fabric, configured as a semi-circle and having:

i. a leading edge diameter defined as a headband with fastening portions extending laterally on each side of said semi-circle, said headband at its median portion being positioned over the forehead and adjacent the ears of the wearer with said fastening portions overlapping and being secured to each other behind the head at the nape of the neck; and ii. a semi-circular trailing edge defining an arcuate body portion contiguous with said headband and adapted for covering the head and neck of the wearer wherein edges of a segmental section are joined by stitches extending radially from the center of said semi-circle adjacent its trailing edge inwardly towards the dome of the wearer and two further seams equidistantly extending radially from the dome of the wearer's head outwardly to the semi-circle trailing edge, so as to define a pyramidal fold within said semi-circle; and B. complementary fastening means secured to said fastening portions, so as to secure said portions to each other at a point of overlap adjacent the nape of the wearer's neck.

3. A headdress as in claim 2, further including:

C. at least one frictional pad supported on the underside of said headband, so as to engage a side of the wearer's head.

* * * * *